US006106216A

United States Patent [19]

Hogan

[11] Patent Number: 6,106,216

[45] Date of Patent: Aug. 22, 2000

[54] VEHICLE SIDE TILTING APPARATUS WITH WHEEL ROCKER

[76] Inventor: Sherman David Hogan, P.O. Box 57638, Salt Lake City, Utah 84157

[21] Appl. No.: 08/906,607

[22] Filed: Jul. 21, 1997

Related U.S. Application Data

[62] Division of application No. 08/510,601, Aug. 3, 1995, Pat. No. 5,775,870.

[51] Int. Cl.[7] ..... B66F 7/28

[52] U.S. Cl. ..... 414/678; 254/94

[58] Field of Search ..... 414/359, 360, 414/371, 372, 426, 678, 778, 782; 254/94; 269/55; 280/402

[56] References Cited

U.S. PATENT DOCUMENTS

| | | | |
|---|---|---|---|
| 1,184,291 | 5/1916 | Wilson | 414/426 |
| 1,288,138 | 12/1918 | Nicosin . | |
| 1,334,336 | 3/1920 | Weimar . | |
| 3,154,206 | 10/1964 | Gillette, Jr. et al. | 414/426 |
| 3,214,042 | 10/1965 | Westrum | 414/426 |
| 3,674,252 | 7/1972 | Crabtree et al. . | |
| 4,434,993 | 3/1984 | Curtis | 280/402 |
| 4,579,505 | 4/1986 | Lauritsen | 414/678 |
| 4,594,048 | 6/1986 | Sipla | 414/678 |
| 4,744,717 | 5/1988 | Dyer | 414/678 |
| 4,761,015 | 8/1988 | Carr | 280/402 |
| 4,971,511 | 11/1990 | Stevens et al. | 414/678 |
| 5,238,361 | 8/1993 | Liqui | 414/678 |

*Primary Examiner*—Janice L. Krizek

[57] ABSTRACT

A vehicle side tilting apparatus having strap-on wheel rockers to attach to wheels at one side of a vehicle and lift structure to elevate the other side of the vehicle and to roll the vehicle on the wheel rockers until the raised side of the vehicle is upright or slightly over center, where it is held even after removal of the lift structure and during movement of the tilted vehicle.

21 Claims, 16 Drawing Sheets

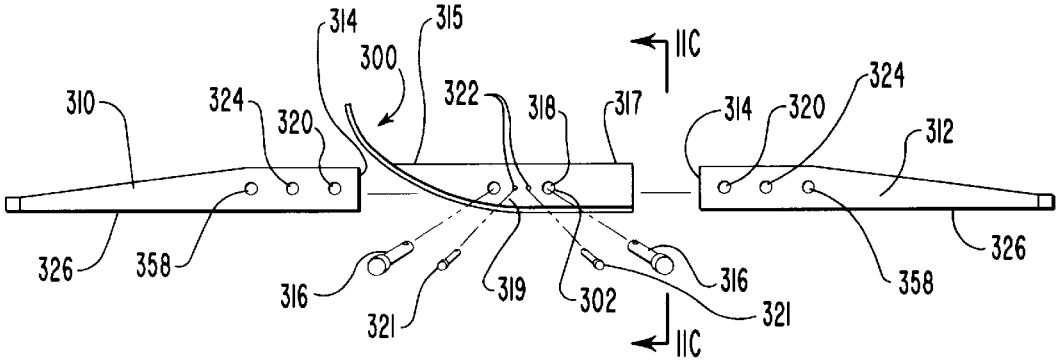
FIG. IIB
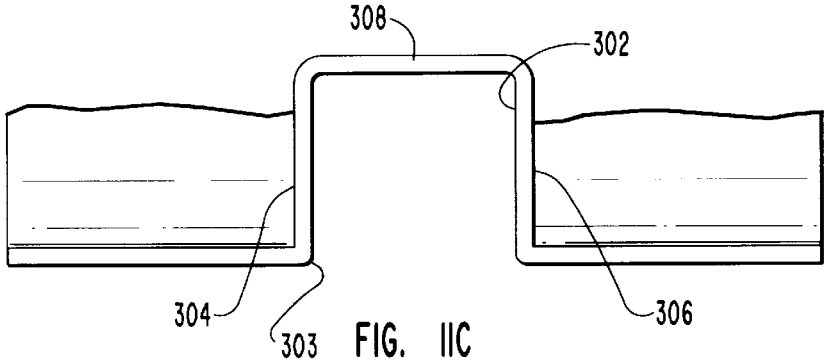
FIG. IIC
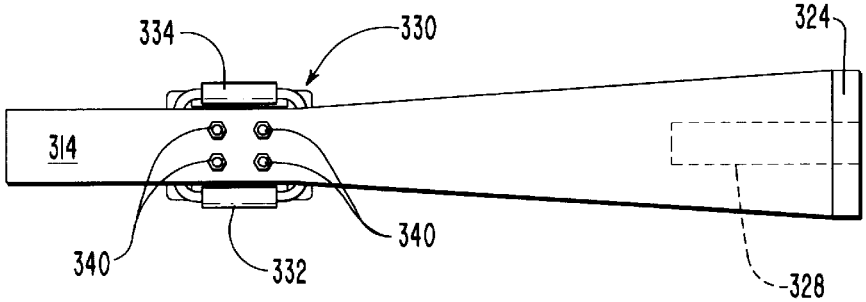
FIG. IID
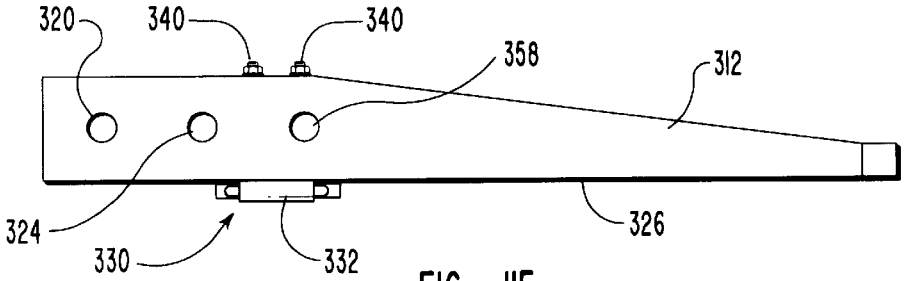
FIG. IIE

VEHICLE SIDE TILTING APPARATUS WITH WHEEL ROCKER

This application is a divisional of application Ser. No. 08/510,601, filed Aug. 3, 1995, now U.S. Pat. No. 5,775, 870.

BACKGROUND OF THE INVENTION

1. Field of the Invention

This invention relates to devices used to tip vehicles to their sides while raising and exposing the under-surfaces of the vehicle and lowering and exposing the top surfaces, thereby making such surfaces accessible for inspection or work thereon.

2. State of the Art

The need for access to the undercarriage of a vehicle is well known. Often, for example, it is desirable to coat the entire undercarriage with a rust preventative coating. Sand blasting, painting and washing of vehicle undercarriages are desirable as maintenance procedures. Periodic maintenance requires that joints and couplings be frequently lubricated. Transmissions and differential units needing repair are often accessible only from beneath the vehicle and it is not uncommon that the oil in such units must be changed or that other servicing of the units is required. Other vehicle components such as starter motors, radiators, clutches, exhaust systems and fuel tanks, for example, may also have to be worked on from time to time and often are only accessible when the undercarriage is exposed.

In recent years the majority of new automobiles produced and sold have a unibody chassis, without an independent frame and for most of these vehicles it is only possible to remove the engine and transmission from the bottom of the vehicle, should that become necessary.

Government officials often need to inspect the undercarriages and tops of vehicles in locating illegal drugs and other contraband.

In general, the undercarriages of vehicles have been accessed either by sliding beneath a vehicle; positioning the vehicle over a pit in which a person may stand beneath the vehicle; or lifting the vehicle to a height that will allow a person to stand beneath the vehicle. Backyard mechanics frequently use a wheeled platform known as a creeper to propel them beneath a vehicle and it is not uncommon that the vehicle is supported by jacks and stands while the individual moves beneath on the creeper. Such an arrangement is often unsafe, since the jack(s) and support stands used may not provide adequate support and may allow the vehicle to drop. Dirt, oil, rust, paint, sand blasting particles, welding, slag, sparks from welding, gasoline and diesel fuel and even automotive parts invariably fall on a mechanic beneath the vehicle, with sometimes severe consequences to eyes and the like. Even professional mechanics may elect to use jacks and jack stands to perform a job when all available pits and/or hoists are occupied.

Pits are very permanent, expensive structures. Excavation of the pit is required and for safety purposes the pit walls must be made strong enough to prevent any possibility of collapse as a vehicle is driven and positioned over the pit. Once installed the pit cannot thereafter be moved for use at a different location and even tearing out and filling the pit can become a problem when the pit is no longer to be used. It is not uncommon that people are injured as a result of falls into open pits or that vehicles being driven onto tracks miss the tracks and fall into the pits. Furthermore, once the vehicle is driven onto tracks extending across a pit the tracks remain in place to obscure the view of and access to portions of the undercarriage.

Hoist and rack units that will allow a vehicle to be driven onto or over a rack that is then lifted by hydraulic cylinder retractable into a shop floor have also long been used. Such units are also essentially permanently installed, cannot be moved from location to location for use, and are very expensive to construct and install. They also provide permanent visual obstructions as well as preventing access to portions of the undercarriage. Permanently installed hoist and rack units are also costly to remove when it becomes necessary that this be accomplished.

More recently hoist and rack units have been developed that are less permanently installed. Such units may have four corner support posts and drive on ramps leading to support platforms, or vertically lifted and lowered platforms raised after the vehicle is positioned thereon. Other units have a pair of support legs connected by a top beam and support racks reciprocable on the legs to hold the vehicle in a balanced condition.

Even the newer hoist and rack units must be secured to a floor, or the like, so that they will have stability during use. These units also necessarily have components that will block vision and access by a user working beneath a vehicle. In addition, care must be taken when removing heavy components or adding heavy components to a vehicle on such units that adequate balance of the vehicle is maintained.

No matter what type of overhead support is used for a vehicle, a person working beneath and looking up is subject to neck fatigue resulting from bending the neck to look up and the holding of tools, part, etc. overhead. Back and arm fatigue can also occur.

A number of proposals have been made for apparatus that can be used to tilt a vehicle to its side so that the undercarriage is exposed. The advantage of such a unit is that it can usually be constructed at a lower cost than is associated with vertical lift hoists and, it can be made mobile and easily moved from location to location. However, all such apparatus, with which I am familiar, include lifting structure that must remain in place even after the vehicle is fully tilted and that will, like other structures previously described, obscure vision of and interfere with access to portions of the vehicle undercarriage.

It should also be apparent that with a side tilt unit no one must work beneath a vehicle. Accordingly, dirt, loose rust, oils, rust preventatives and other debris falls harmlessly, without dropping onto the worker. Also, there is no danger that the vehicle or pieces of the vehicle will fall onto a worker should support fail or should the worker or another party simply lose their grasp on a component. This, of course, is a constant danger to workers beneath a vehicle raised by a hoist, lift or jacks.

U.S. Pat. No. 1,288,138 discloses apparatus for tilting a vehicle to its side for servicing, or the like. As disclosed, the apparatus includes a pair of U-shaped cradles that will support a vehicle between them as the vehicle is turned to its side. U.S. Pat. No. 1,334,336 discloses a vehicle retaining frame structure with a curved sidewall. The frame is connected to an arm that supports a variable weight member. When the weight member has sufficient weight thereon the frame is tilted to place the vehicle on its side.

More recently structures have been developed to have arc-shaped support members that are attached, using special wheel lug bolts, to the hubs at one side of a vehicle. A force applied to the other side of the vehicle then rolls the vehicle to its side as it is supported on the arc-shaped support members. Such structures are shown, for example in U.S. Pat. Nos. 3,674,252, 4,579,505, 4,594,048 and 4,971,511.

U.S. Pat. No. 4,971,511 utilizes a hoist having a base shaft, a lifting shaft having one end pivotally mounted to one end of the base shaft, and a mast shaft having one of its ends pivotally mounted to the other end of the base shaft. The end of the lifting shaft not pivotally connected to the base shaft travels along the mast shaft under control of a powered hoist. The powered hoist comprises a winch fixed to the mast shaft and a cable wrapped around the winch and passing over a pulley system and having its running end fixed adjacent to the end of the lifting shaft that is guided along the mast shaft. With the lifting shaft extending beneath a vehicle such that the front wheels of the vehicle are at one side of the lifting shaft and the rear wheels of the vehicle at an opposite side of the lifting shaft, the attached end of the lifting shaft travels along the mast shaft to tilt or lower a vehicle having the wheels on one side of the vehicle connected to cradle members interconnected by a shaft to which the lifting shaft is pivotally attached, about the cradle members.

The apparatus disclosed in U.S. Pat. No. 4,971,511, while useful in many instances, has limitations and restrictions that reduce the overall usefulness of the device and its acceptability for vehicle tipping. It has been found, for example, that the mast shaft used must be in the neighborhood of eleven feet long. This makes the device impossible to use in a room having a ceiling that is less than eleven feet high. Consequently, the apparatus is not adaptable to use in most home garages and small commercial buildings. Furthermore, such length means that the apparatus is not readily transported in most pick-up trucks or vans.

As disclosed in the patent the cradle members are bolted to the wheels or hubs of the vehicle using special new lug nuts or bolts. It has been found, however, that the threads on even the new nuts or bolts often strip and release the cradle. Even if the nuts or bolts do not strip it is very time consuming to make the bolted attachment. Furthermore, each make and often each model of vehicle will have a different lug bolt pattern and may require different sizes or kinds of threads. As a result, considerable time is involved in bolting the cradles to or releasing the cradles from the lug bolts of a vehicle that is tipped. A standard six lug wheel requires the installation and removal of each nut or bolt four times. Thus, for each wheel there are twenty-four nut installations and removals. For both wheels, on one side of a vehicle, there are forty-eight nut or bolt installations and removals during a vehicle tilting procedure. This equates to thirty to forty-five minutes of the user's time per procedure.

None of the patents cited herein disclose a vehicle tilting apparatus designed to hold a vehicle in a tilted position even when the hoisting unit associated with the tilting apparatus is removed. Consequently, the prior art units will not allow convenient use in an automobile sales room, where it is desired that top and bottom of a vehicle be fully displayed. The cited prior art patents also fail to disclose strap on wheel rockers that are attached to wheels at one side of a vehicle and that will function with virtually any method of lifting the opposite side of the vehicle to position the vehicle in a side tilted position. The wheel rockers are constructed to maintain the tilted position and to permit movement of the tilted vehicle.

Principal objects of the present invention are to provide a "user friendly" side tipping apparatus for a wide variety of vehicles that is easy to operate by a single individual, that is reliable in use, that is fail safe and that is adaptable for use in a great many locations and for many purposes.

Principal features of the invention include spaced apart wheel rockers for use on the wheels at one side of a vehicle. Additional rockers may be used, as required, by the vehicle being tilted and the lifting structure and such rocker or rockers may be connected to a rocker bar extending between one or more rockers. A vehicle engagement apparatus is movable axially with respect to a base shaft for adjustable positioning against undercarriage components of the vehicle being tilted.

Each wheel rocker is secured to a wheel with straps and the wheel rocker may have at least one strap tightener thereon to facilitate locking of the rocker to the wheels. Guide bars may also be used with the straps, or independently, to position the wheel rockers to the wheels. A load distribution plate may be positioned between each wheel rocker and a wheel to which the rocker is attached if the size of the wheels is large enough to require such a distribution plate.

For use with trailers, a trailer ball receiving bar with a ball thereon is connected to a rocker which is interconnected by a rocker bar to other rockers being used.

Extension arms each have one end to be telescoped into fittings on the wheel rockers such that the entire assembly, including the vehicle can be moved using a dolly in the direction of the length of the vehicle, in a transverse direction or in a swinging pattern. The extension arms additionally cooperate with the rockers to maintain a fully tilted vehicle in position, when the lift mechanism is removed to provide unobstructed access to the vehicle undercarriage. The extension arms may have wheels or support plates affixed thereto or may have removable roller sets cooperating therewith to roll on floor plates placed over carpeting or the like.

In one preferred embodiment of the invention a support arm pivotally connected between the lower end of a movable mast shaft and intermediate the length of the base shaft provides support for the base arm as it is raised or lowered by power means carried by the mast. So arranged, the mast shaft follows the vehicle as the tilting proceeds. With the addition of extension arms to the wheel rockers, once a full ninety-degree plus tilt is achieved the base shaft support arm, base arm and mast shaft may be wheeled away and the user has unencumbered access to the entire undercarriage of the vehicle. This can be very important, for example, when the vehicle side tilting apparatus is used in a muffler replacement business and where different vehicles have the exhaust systems and mufflers located at different positions beneath the vehicles.

In another preferred embodiment of the invention the base shaft is pivotally connected intermediate its length to one end of a movable mast shaft. A support arm is pivotally connected at its opposite ends to power means carried by the mast shaft and to the base shaft near the end of the base shaft remote from the central rocker.

Extension arms are also provided that have flared ground engaging surfaces extending from the wheel rockers and roller sets attached to the extension arms. Extension arms extend from intersecting sockets on the wheel rockers and those extension arms extending in the direction of travel of the vehicle as it is tilted are angulated to provide ground engagement when the vehicle is fully tilted.

Additional objects and features of the invention will become apparent to those skilled in the art to which the invention pertains from the following detailed description and drawings.

THE DRAWINGS

In the drawings:

FIG. 1 is an end elevation view of a first embodiment of the vehicle side tipping apparatus of the invention, and showing an upright vehicle positioned thereon;

FIG. 2, a view like that of FIG. 1, but showing the vehicle partially tipped to one side;

FIG. 3, an enlarged perspective view showing a wheel rocker of FIGS. 1 and 2, mounted to a vehicle wheel;

FIG. 3A, a fragmentary perspective view showing the connection of the straps of the wheel rocker of FIG. 3;

FIG. 4, a section view, taken on the line 4—4 of FIG. 3;

FIG. 5, a perspective view of the embodiment of the invention shown in FIGS. 1 and 2;

FIG. 6, a greatly enlarged view taken within the line 6—6 of FIG. 2 showing the base shaft, fragmentarily, the upright mast fragmentarily, the worm screw and the traveling block;

FIG. 7, an exploded perspective view of the vehicle side tipping apparatus of the invention;

FIG. 8, a perspective view of the invention with the lift mechanism removed after a vehicle has been fully tilted;

FIG. 9, a perspective view of another embodiment of the invention;

FIG. 9A, a view like that of FIG. 3, but showing use of a wheel extension arm;

FIG. 9B, a view like that of FIG. 9A, but showing an extension arm with an adjustable pad;

FIG. 10, an enlarged perspective view of the wheel rocker of the embodiment shown in FIG. 9, attached to a vehicle wheel, shown in phantom;

FIG. 11, a perspective view of a wheel rocker with extension arms and a wheeled tow truck for moving a tilted vehicle shown fragmentarily in phantom;

FIG. 11A, an enlarged, exploded perspective view of a wheel rocker mounted to a vehicle wheel with extension arms, wheel roller set and tow truck;

FIG. 11B, an exploded side elevation view of a wheel rocker and a pair of extension arms;

FIG. 11C, a fragmentary end elevation view of a wheel rocker;

FIG. 11D, a top plan view of an extension arm with an attached roller set;

FIG. 11E, a side elevation view of an extension arm and wheel set of FIG. 11D; and FIG. 12, a perspective view of a trailer, shown fragmentarily with a tongue connection and a wheel rocker.

DETAILED DESCRIPTION

Figure 1:
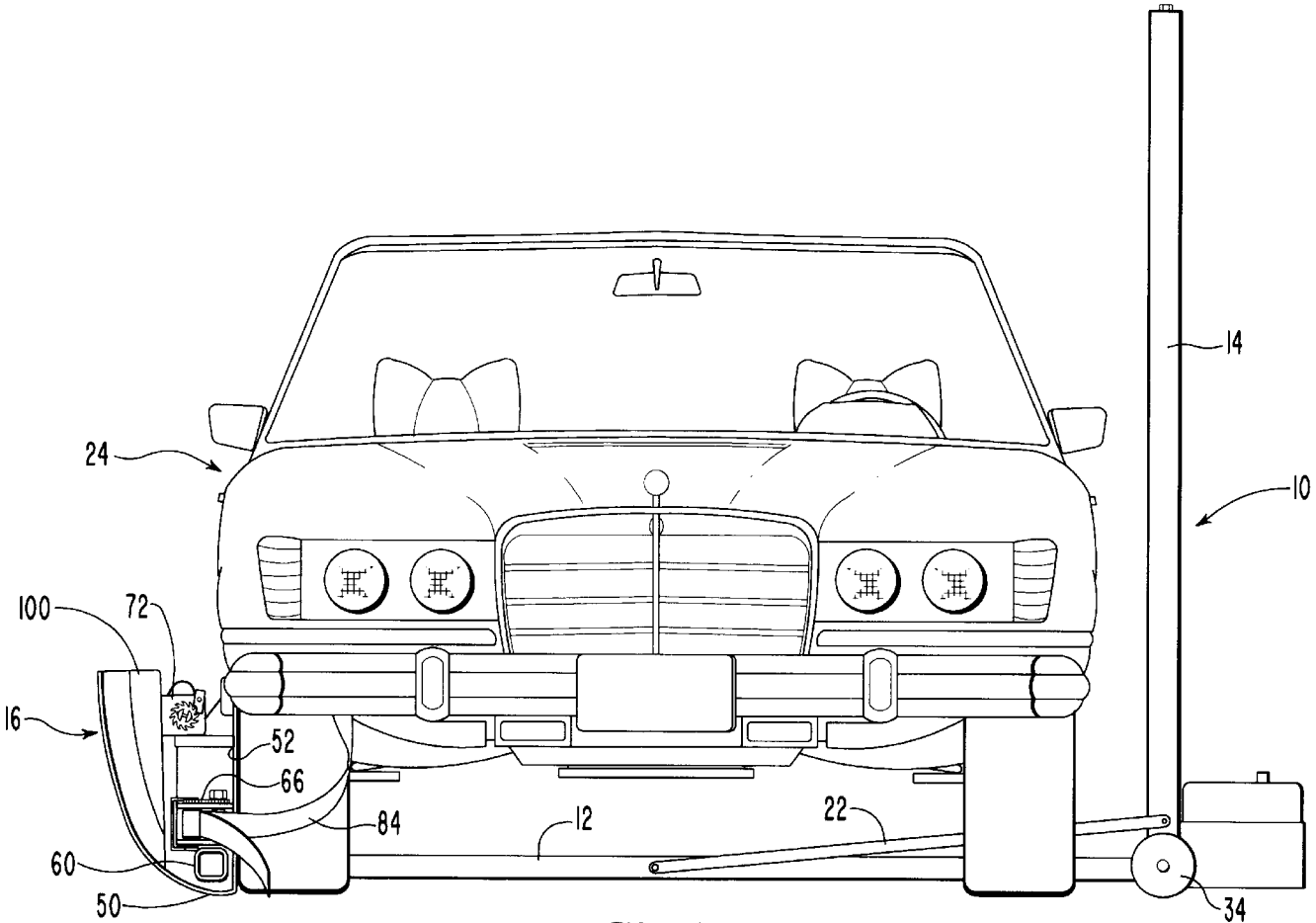
Figure 2:
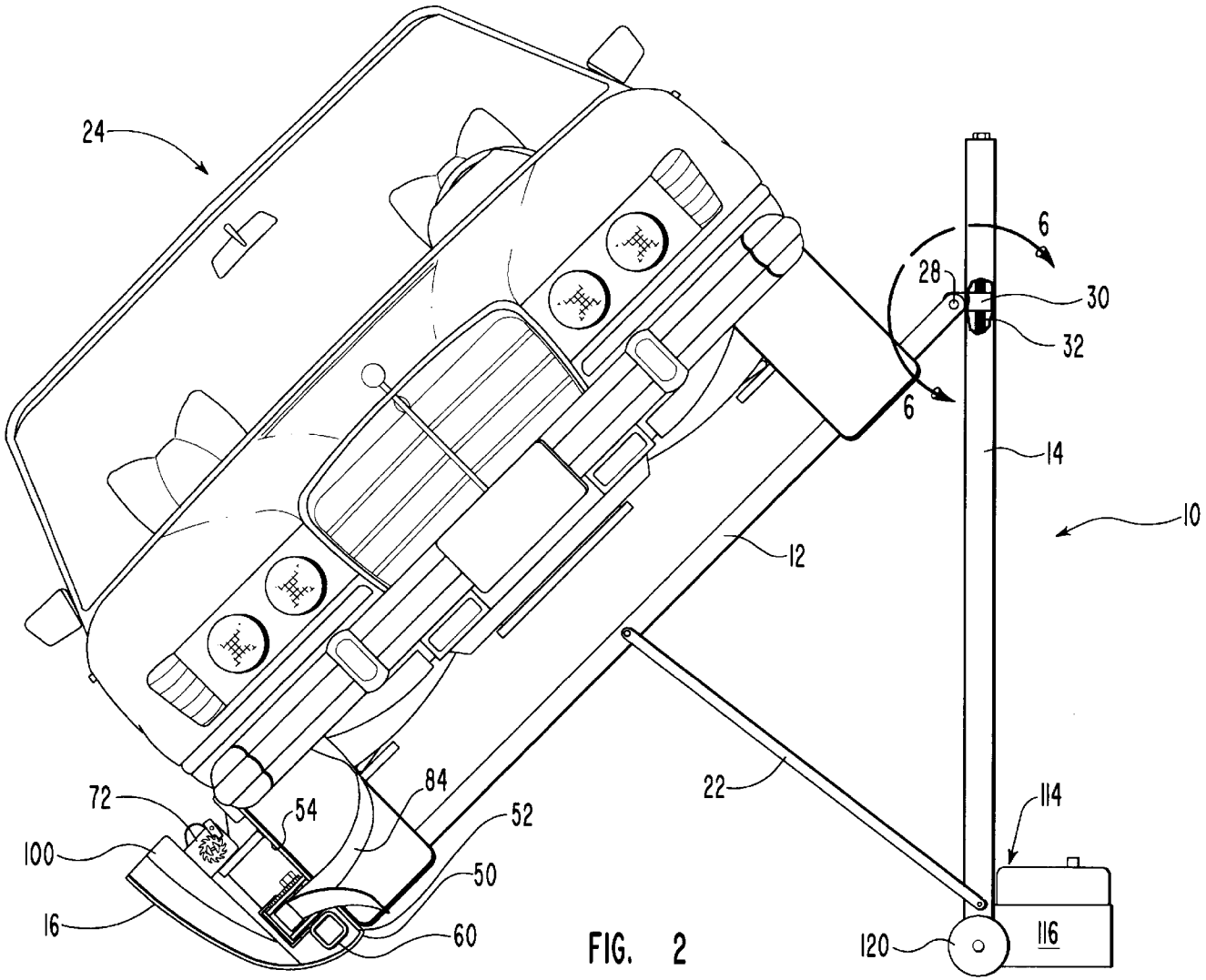

Referring now to the drawings:

In the illustrated embodiment of the invention shown in FIGS. 1–7 the vehicle side tipping apparatus is shown generally at 10 and includes a base shaft 12; an upright mast 14; a pair of wheel rockers 16 and 18; a central rocker 20; and a support arm 22.

Base shaft 12 is adapted to extend fully beneath an upright vehicle, shown at 24. One end 26 of base shaft 12 is pivotally attached at 28 to a block 30 that travels up and down the upright mast 14 on a worm screw 32. The other end of base shaft 12 has rollers 34 and 36 (FIG. 7) mounted thereon and is releasably connected to a transversely extending rocker support bar 38 on which the wheel rockers 16 and 18 and central rocker 20 are mounted.

The rocker support bar 38 has non-circular cross-section so that while the wheel rockers 16 and 18 and central rocker 20 may slide along the rocker support bar, they do not rotate with respect to the bar. Rather, the rockers and bar will rotate together. It will be apparent that other structures that will provide for connected, simultaneous rotation of component parts can be used in place of the mating non-circular configuration shown and described. Telescoping circular tubes and locking pins, not shown, can be used, for example, as well as other non-circular mated cross-sectional configurations. Central tipping rocker 20 has a lower end 39 fixed to an arm 40 projecting from a non-rotatable sleeve 42 hat reciprocates on the rocker support bar 38. Rocker 20 has the same arcuate configuration as the wheel rockers 16 and 18, with the lower end 39 of the rocker 20 being easily and quickly connected to the end of base shaft 12 having the rollers 34 and 36 mounted thereon. The end of base shaft 12 is bifurcated at 43 to receive a tongue 44 projecting from the lower end 39 of rocker 20 and a pin 46 is inserted through rollers 34 and 36 and the bifurcated ends and the tongue 44 to removably secure the base shaft 12 and central tipping rocker 20 together and to hold the rollers in place.

Each of the wheel rockers 16 and 18 is arcuately shaped, with a lower portion 50 fixed to a lower segment 52 of a pressure application plate 54 and with the rocker and the pressure application plate mounted to opposite sides of a sleeve 60. The sleeve 60 telescopes, non-rotatably, on the rocker support bar 38.

Figure 3:
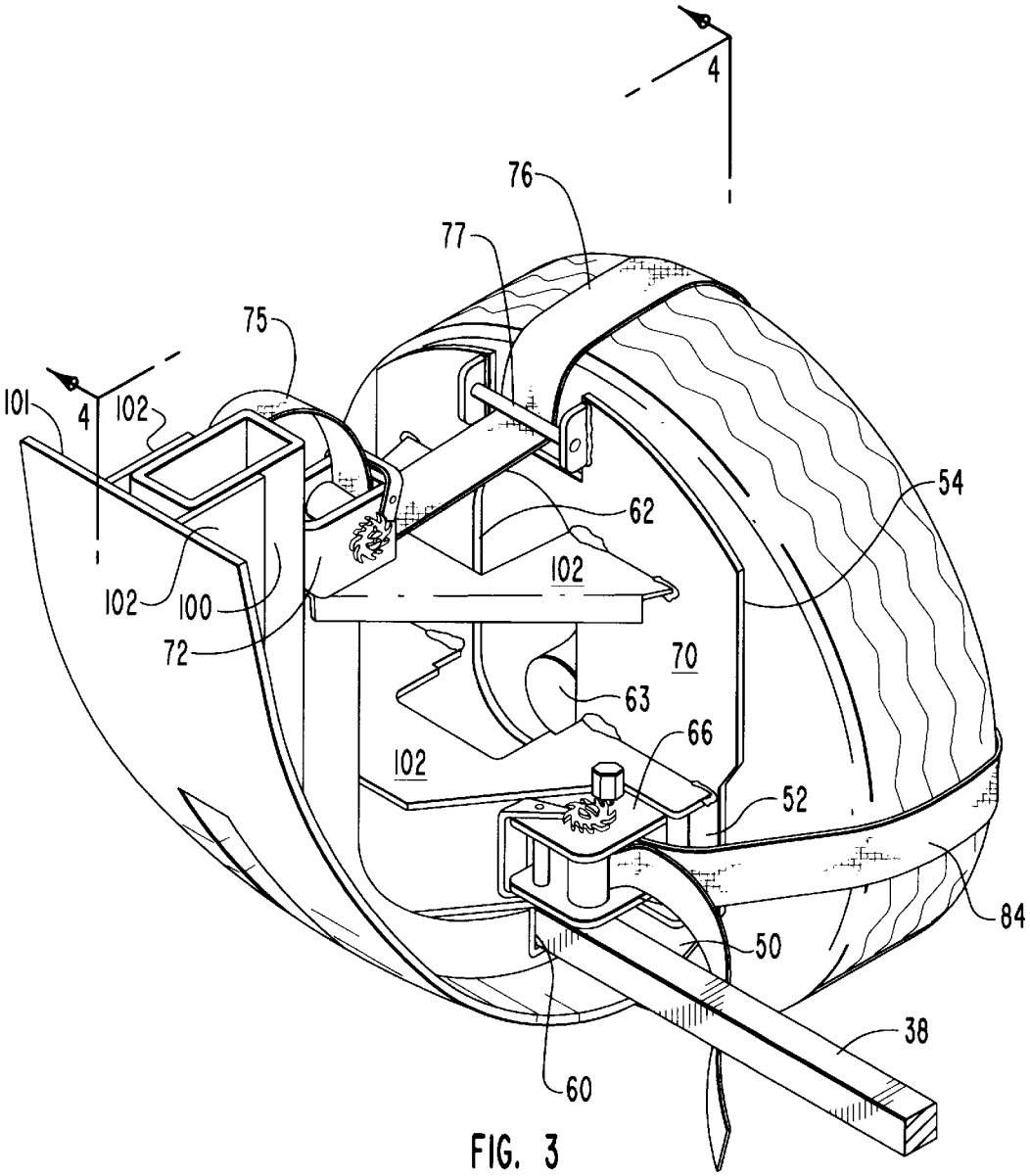
Figure 3A:
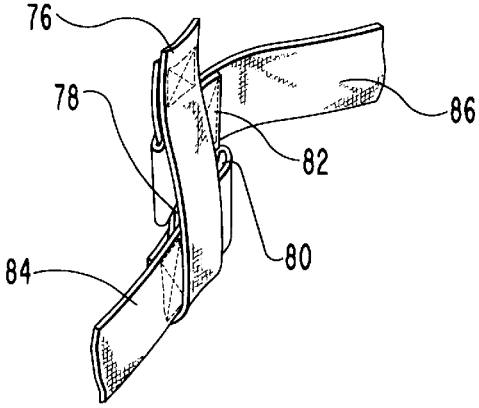
Figure 4:
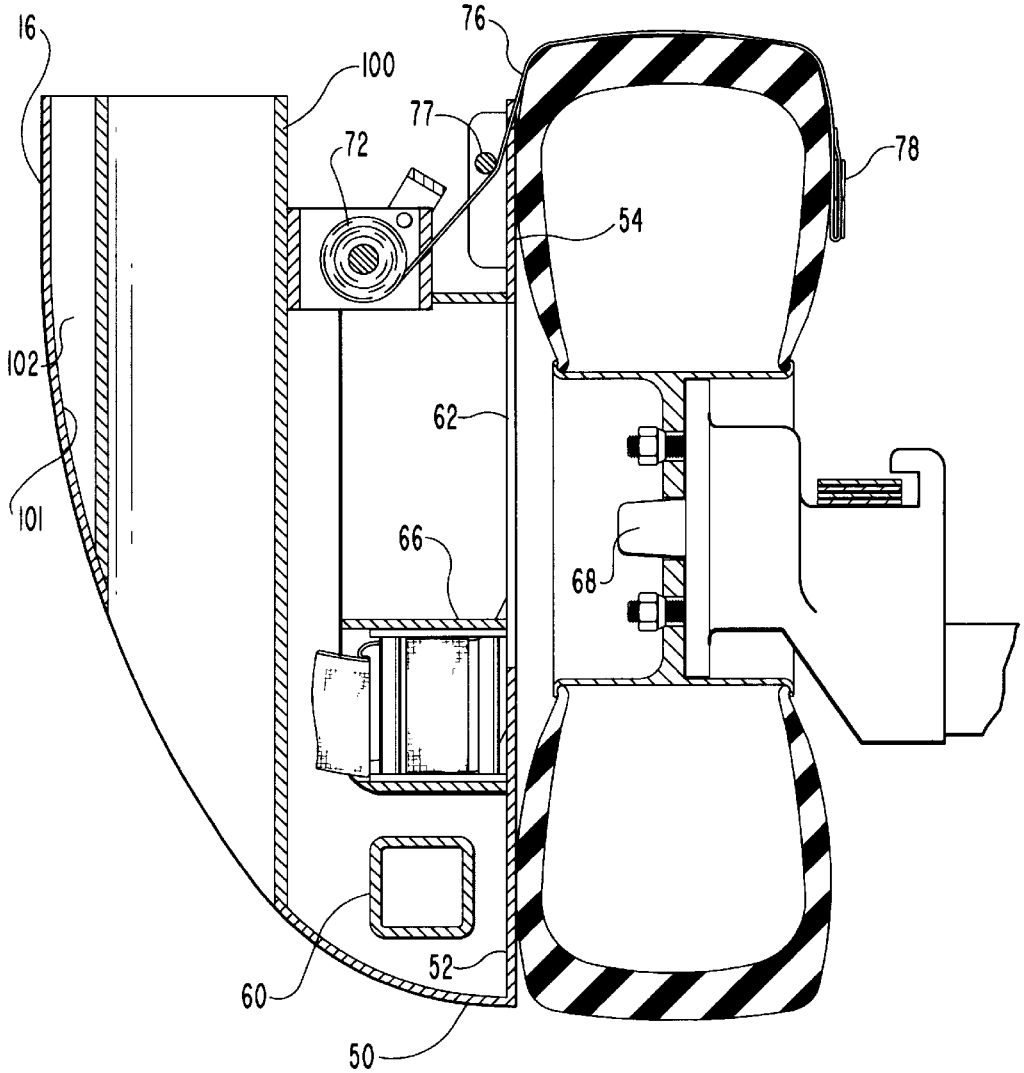
Figure 5:
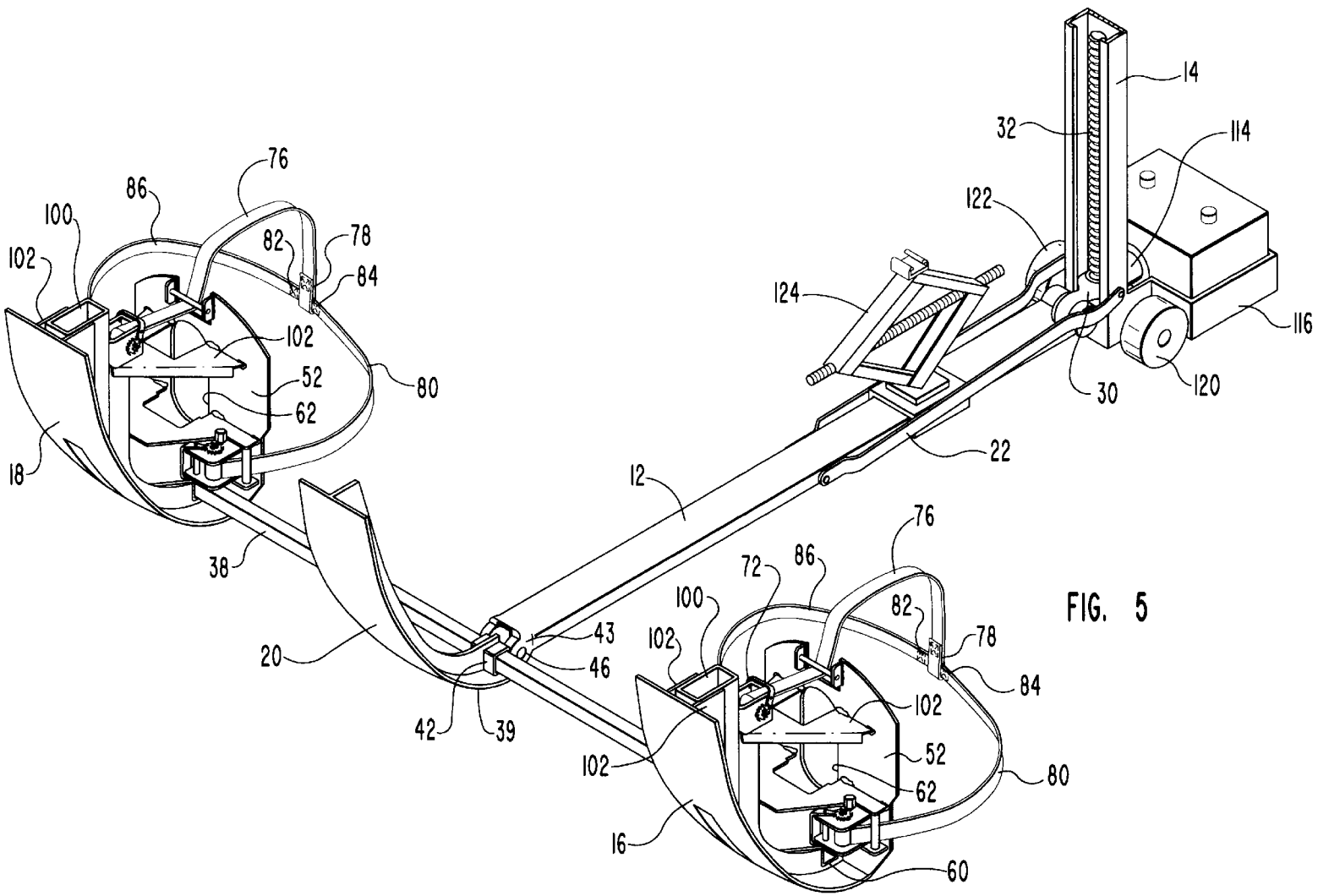
Figure 6:
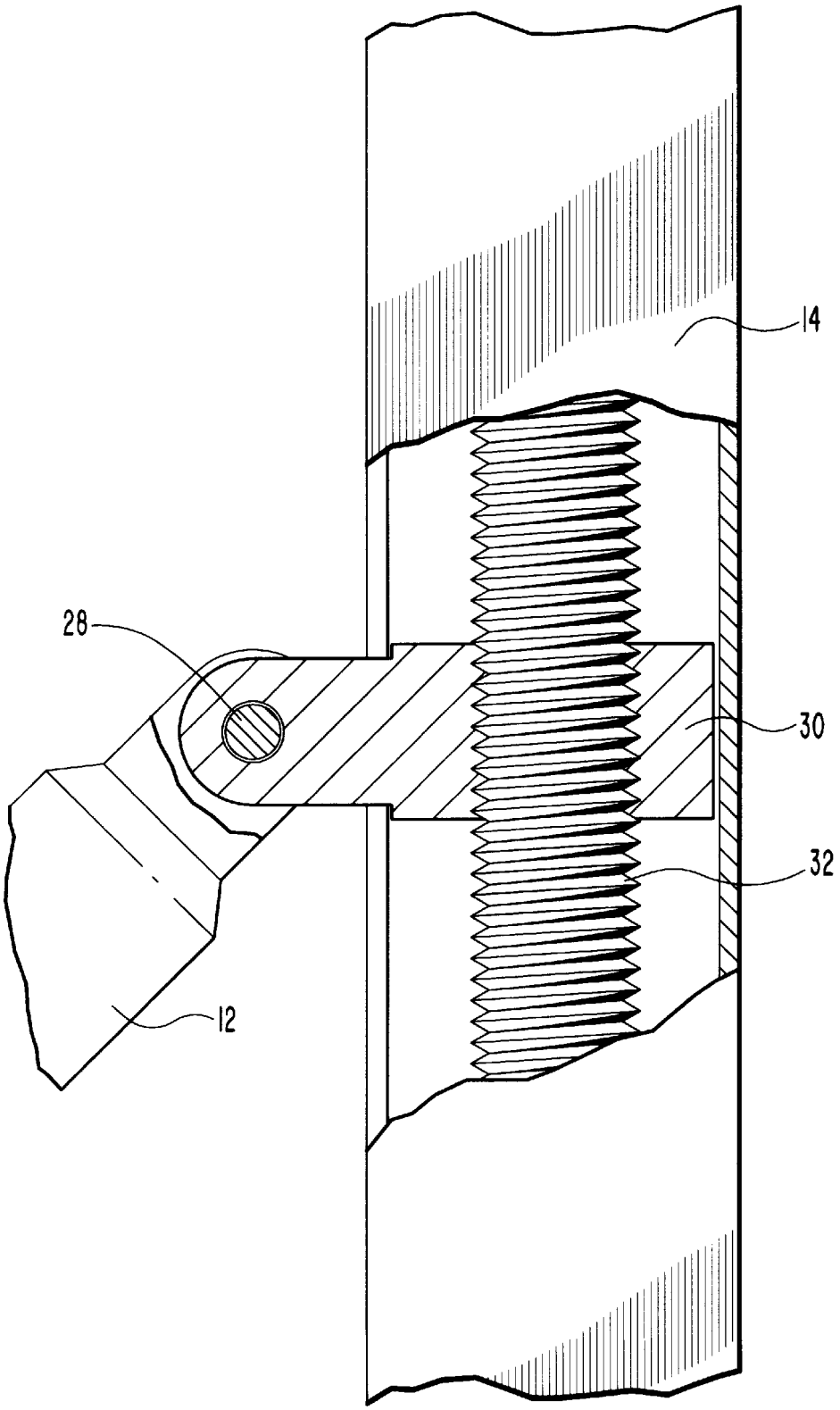
Figure 7:
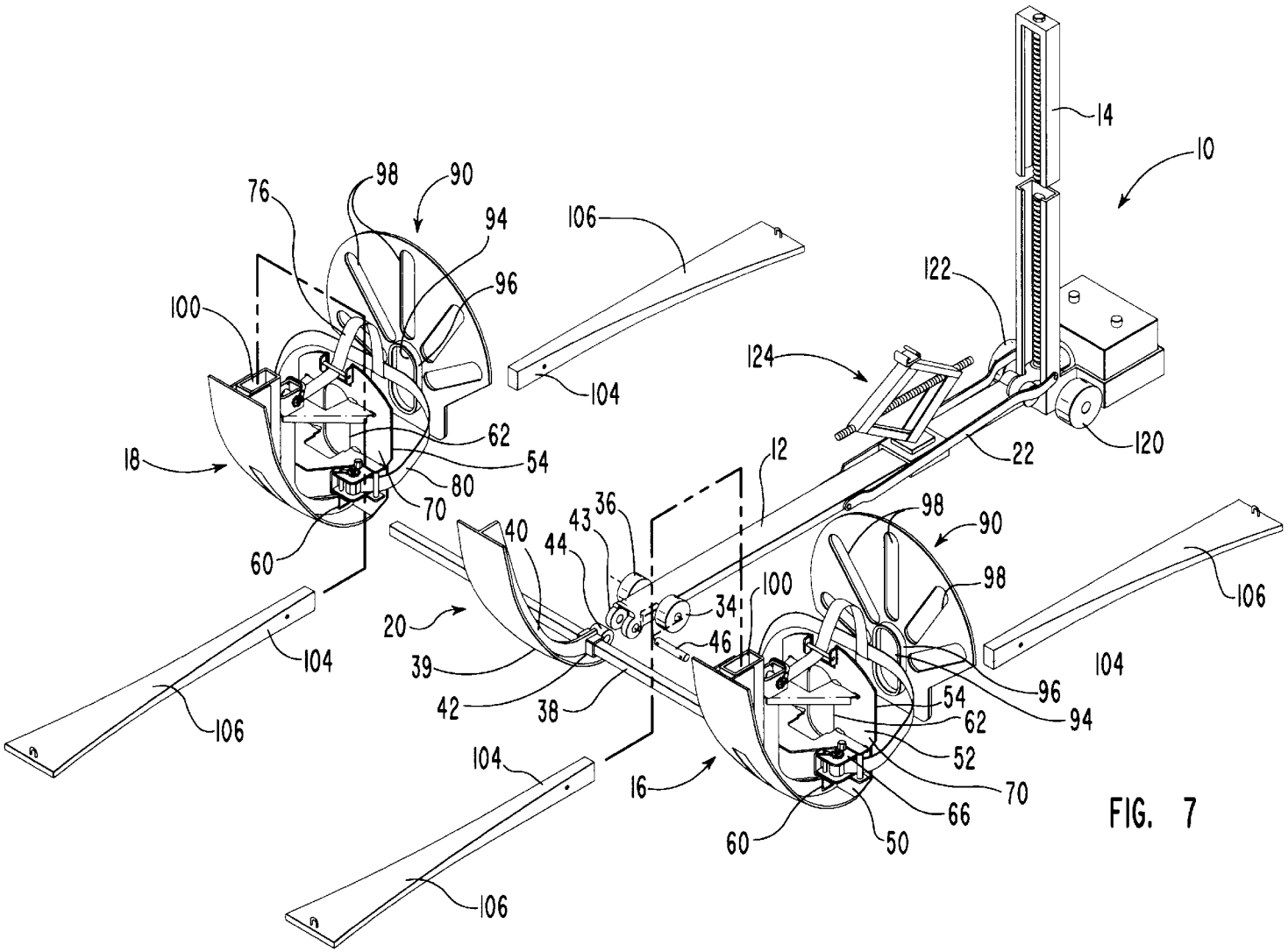

An elongate hole 62 is provided centrally of and at a lower portion of the pressure application plate 54 to allow the plate to fit over a projecting wheel hub 63, FIG. 3. A pair of spaced strap tighteners 66 and 68 are fixed to the pressure application plate 54 on the face 70 thereof facing the rocker 16 or 18 and at a lower portion of the pressure application plate. Another strap tightener 72 is also fixed to the rocker at a top portion thereof. A strap 76 has one end 75 passed beneath a roller 77 fixed to the upper portion of the pressure application plate 54 and through the strap tightener 72. The other end of strap 76 has a loop 78 formed therein and loops 80 and 82 at ends of straps 84 and 86 are connected to the loop 78. The other ends of straps 84 and 86 are respectively passed through the strap tighteners 66 and 68.

A pressure distribution plate 90 (FIG. 7), for use with larger wheels, has an elongate opening 94 surrounded by a flange 96 that just fits into the elongate hole 62 through the pressure application plate 54. The elongate opening 94 allows the pressure distribution plate 90 to fit over a wheel hub (not shown) while the flange 96 fits snugly into the elongate hole 62. Radiating slots 98 in the pressure distribution plate 90 allow the plate to be positioned flat against an automobile wheel (not shown), with any projecting lug bolts and nuts projection through the slots.

In use, each wheel rocker 16 and 18 is positioned along the rocker support bar 38 until the elongate hole 62 through the attached pressure application plate 54 is positioned over a wheel hub. If necessary, because of the large size of the wheel, a pressure distribution plate 90 may be positioned between the pressure application plate and the wheel. The loops 76, 80 and 92 ends of the straps are placed behind the wheel and above the axle of the wheel. The other ends of the straps are then passed through the strap tighteners 66, 68 and 72 and the strap tighteners are actuated to tighten the straps and to hold the pressure application plate 54 and pressure distribution plate 90 tightly against an outer face of the wheel.

It will be apparent that the wheel rockers 16 and 18 can also be attached in the same manner to vehicle hubs should the wheels be removed to facilitate servicing or the like.

A section of squared tubing 100 is fixed to an inner curved face 101 of each wheel rocker 16 and 18. The tubing sections are each welded or otherwise affixed to the interior curve of the wheel rocker and are connected to the corresponding pressure application plate 90 by braces 102.

The section 100 of squared tubing serves as a receiver to telescopingly receive one end 104, having a corresponding cross-sectional configuration, of an extension arm 106.

A variable speed motor 114, which preferably is selectively AC or DC powered, is mounted on a platform 116 provided therefore at the bottom of mast 14. Motor 114 drives the worm screw 32 through conventional gearing (not shown) in either a forward or reverse direction. Operation of the worm screw will cause the block 30 to move up or down on the worm screw, inside the mast 14. Movement of the block 30 carries with it the end of the base shaft 26 that is connected by pivot attachment 28 to the block. Thus, initial movement of the block 30 upwardly raises the attached end of base shaft 26 that is positioned to extend beneath a vehicle and to reach from one side of the vehicle to the other and tries to pull the end of the base shaft having rollers 34 and 36 thereon towards the mast 14. Movement of the mast 14 is stopped by engagement of the wheel rockers and their associated pressure application and pressure distribution plates with the wheels at one side of a vehicle to be tilted. Continued raising of the end of the base shaft pivotally connected to the block 30 will tilt the mast 14 towards the vehicle about the wheels 120 and 122 connected to the bottom of the mast. At the same time a support member 124 carried by the support arm 22 engages the undersurface of the vehicle to raise the side of the vehicle opposite the wheel rockers and to tilt the vehicle on the wheel and central rockers. The ground engaging surfaces of the central and wheel rockers may be coated with a non-skid material (not shown) to insure more positive tilting, without skidding, if necessary or desirable. Also, the rockers may be made as wide as may be necessary to insure proper tilting and proper stability when the vehicle has been tilted to an over-center position and the tilting assembly has been removed. It has been found that if the wheel rockers are made sufficiently wide, i.e. six inches or more, they provide sufficient frictional engagement with the ground surface to prevent turning of the steering wheels of the vehicle as the vehicle is tilted. As the vehicle is tilted the mast 14 moves on wheels 120 and 122 towards the rocker support bar 38.

Support member 124, here shown as a scissors jack, is mounted to slide along the length of the base shaft 12. The jack 124 can be positioned along the length of the base shaft so that it will contact the undersurface of the vehicle at a desired frame, pinch weld, etc. location. The jack 124 can be separately operated to initiate the tilting operation, if so desired. Likewise, the upright mast can be positioned alongside the vehicle to be tilted at any desired location, with the central rocker 20 sliding along the rocker support bar 38 to accommodate positioning of the support member (jack) 124.

Figure 8:
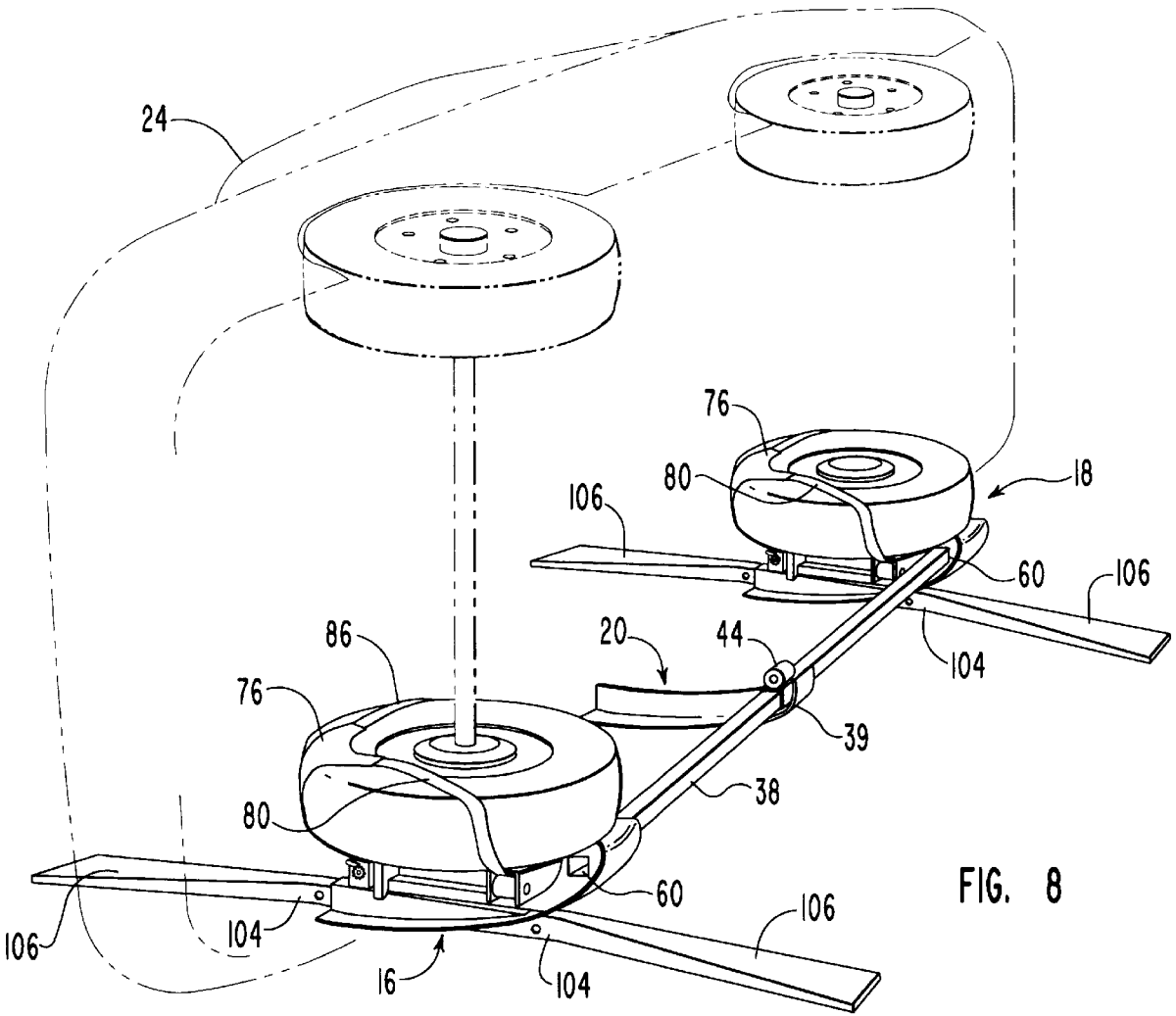

The vehicle side tilting apparatus 10 can be used to lift one side of a vehicle, i.e. the side on which the mast 14 is located, to a desired height, to allow the wheels on that side of the vehicle to be worked on or for brake repair or for the performance of other operations requiring limited lifting of a side of the vehicle. As best seen in FIG. 8, the apparatus 10 can also fully tilt the vehicle to an over-center position wherein the vehicle is supported by the wheel rockers 16 and 18, the central rocker 20, rocker support bar 38 and the extension arms 106 secured to the wheel rockers. In this fully tilted position the base shaft can be disconnected from the central rocker 20 and the vehicle will remain in the fully tilted position, to be worked on, for display or for any other desired reason.

Figure 9:
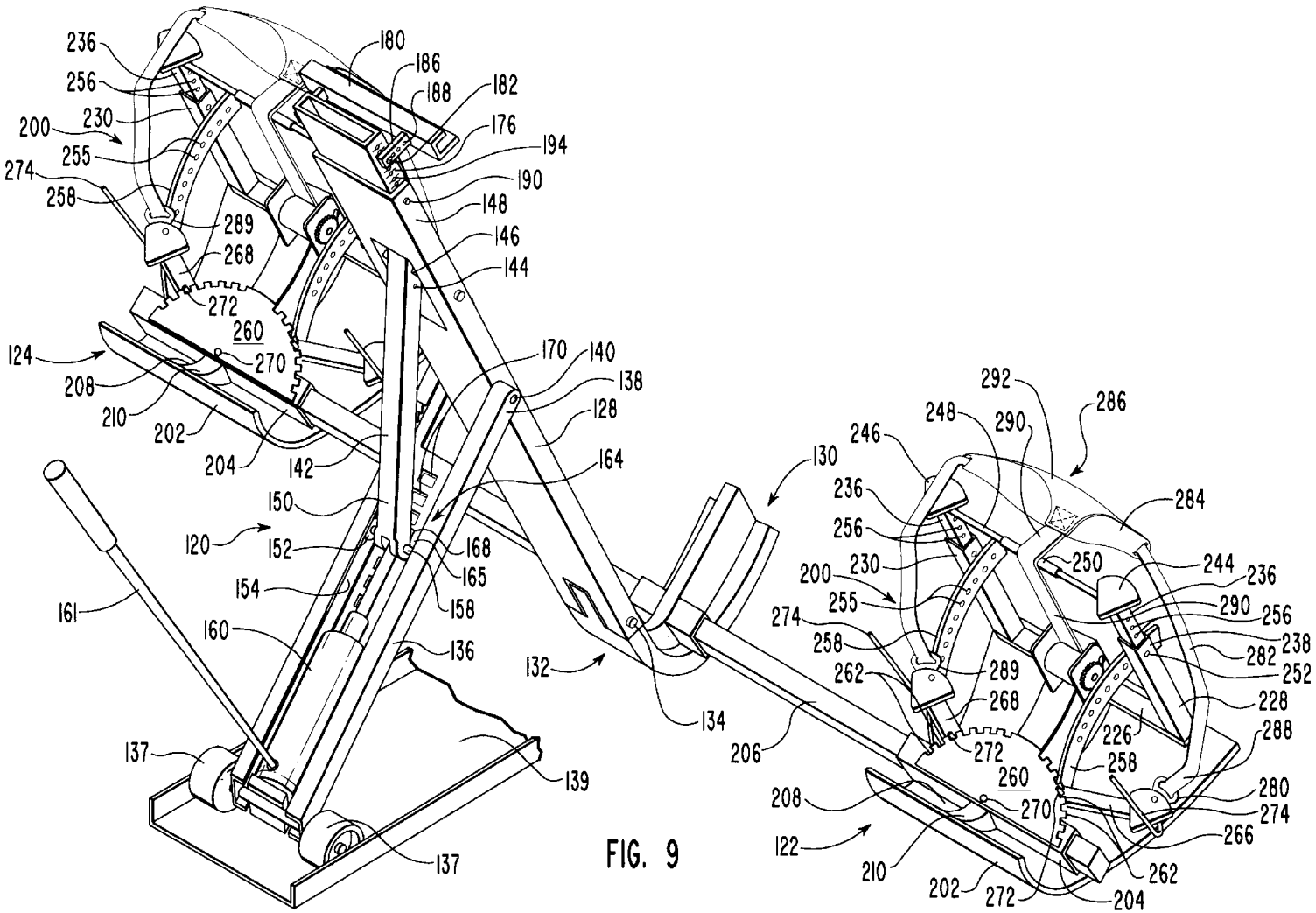

In the preferred embodiment of the invention shown in FIG. 9 the side tilting apparatus, shown generally at 120, includes wheel rockers 122 and 124. The wheel rockers 122 and 124 are each mounted on a rocker bar 126. The wheel rockers 122 and 124 and rocker support bar 126 may be like the wheel rockers and rocker bar previously disclosed. However, the wheel rockers are similar to the type wheel rockers shown in FIG. 10.

Side tilting apparatus 120 includes a base shaft 128 that is removably connected to a central rocker 130 by a clevis coupling 132, including a removable pin 134. A mast shaft 136 has one end 138 connected by pivot pins 140 to the base shaft 128 intermediate the length of the base shaft. The other end of mast shaft 136 has wheels 137 mounted thereon. Wheels 137 may roll within a channeled floor plate 139, shown fragmentarily, laid over carpet or soft ground, if such a floor plate is used to facilitate rolling of the wheels.

A support arm 142 has one end 144 pivotally connected at 146 to near the end 148 of base shaft 128. The other end 150 of support arm 142 has rollers 152 at opposite sides thereof to roll in guideways 154 formed in the mast shaft 136. The end 150 is also pivotally connected by a wheel axle 158 to a reciprocating ram of a hydraulic cylinder 160 carried by the mast shaft. The hydraulic cylinder 160 is manually operated by a pumping handle 161 to expel and retract the ram.

A safety latch, shown generally at 168 keeps the base shaft 128, mast shaft 136 and any vehicle tilted by the base shaft from falling should the hydraulic cylinder fail and the ram inadvertently retract into the cylinder housing. The safety latch drops into notches 170 formed in the mast shaft 136. During expulsion of the ram 158 the safety latch 168 rides upwardly and drags over the notches 170, thus allowing the ram to lift the base shaft. The safety latch 168 drops into a notch 170 to prevent retraction of the ram unless the safety latch is first pivoted to move out of position to drop into a notch 170.

A base shaft extension member 176 telescopes into the end 148 of base shaft 128 and has a vehicle support member 180 secured thereto by bolts 182 inserted through holes 184 in legs 186 and threaded into selected holes 188 in the extension member. The base shaft extension member 176 is secured to the base shaft 128 by bolts 190 inserted through holes in walls of the base shaft and threaded into selected holes 194 in walls of the extension member 176.

Figure 10:
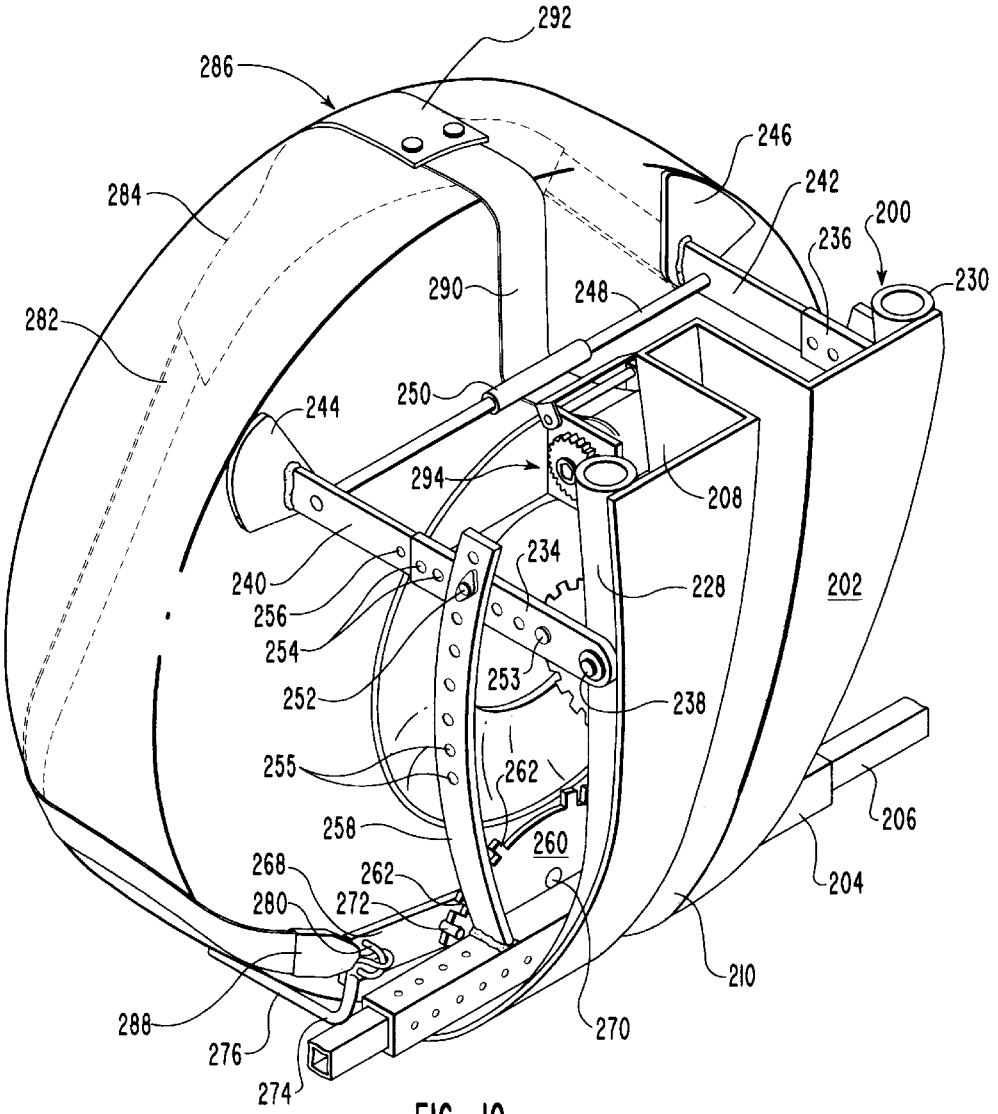

As shown best in FIG. 9 and 10, other embodiments of wheel rockers are shown generally at 200. Each wheel rocker 200 includes a wide, arcuate rolling member 202, shown as having a square tubing member 204 at one end thereof. The rocker bar 206 also shown made of square tubing, telescopes into the tubing member 204 and functions in the same manner as the rocker support bar 38, previously described during tilting and return to upright position of a vehicle.

Another square tubing socket receiver 208 is fixed centrally of the rolling member 202, extends inside the arcuate curve to adjacent the other end of the member 202 opposite the tubing member 204 and terminates at an opening 210 through the curved rolling member 202.

Figure 9A:
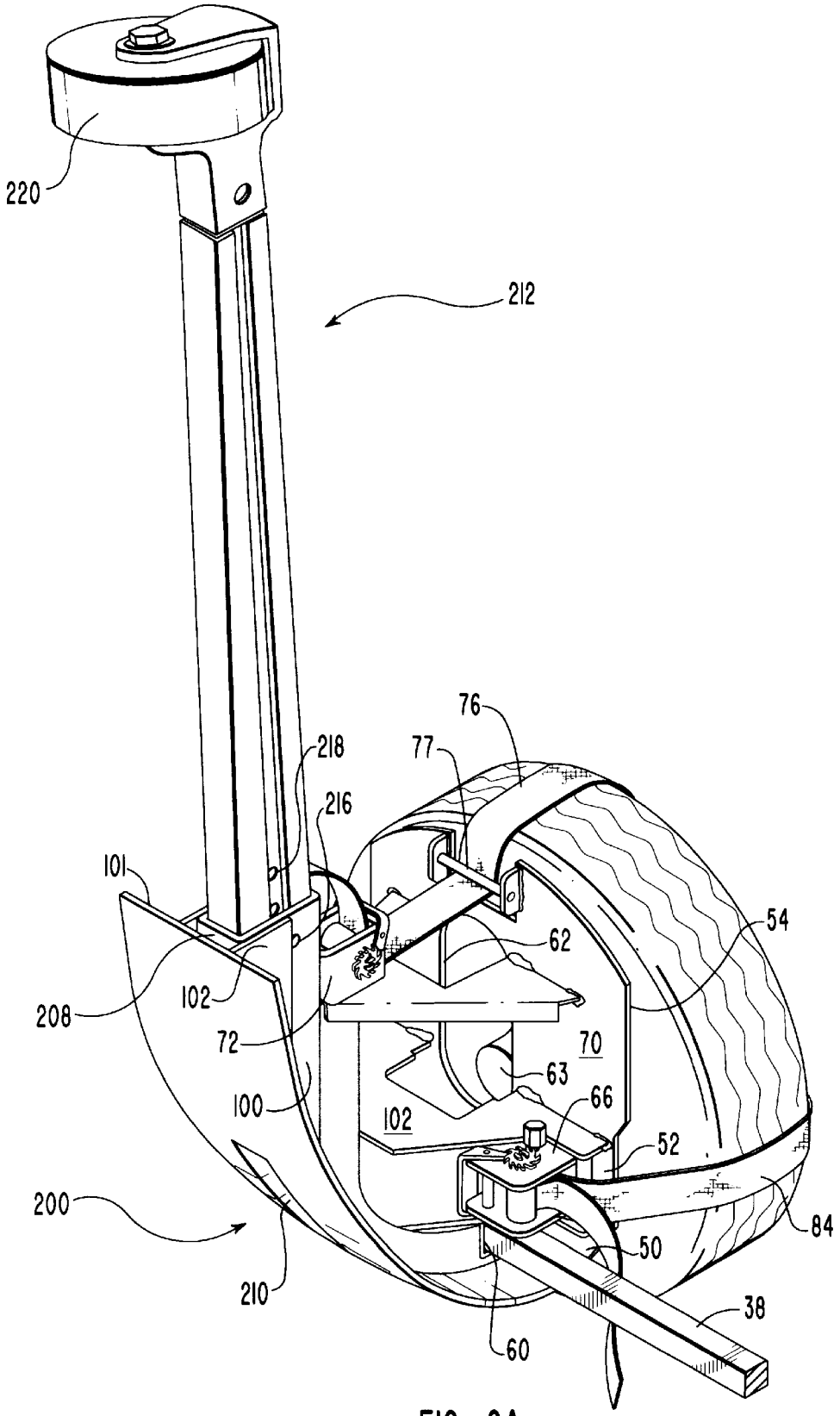
Figure 9B:
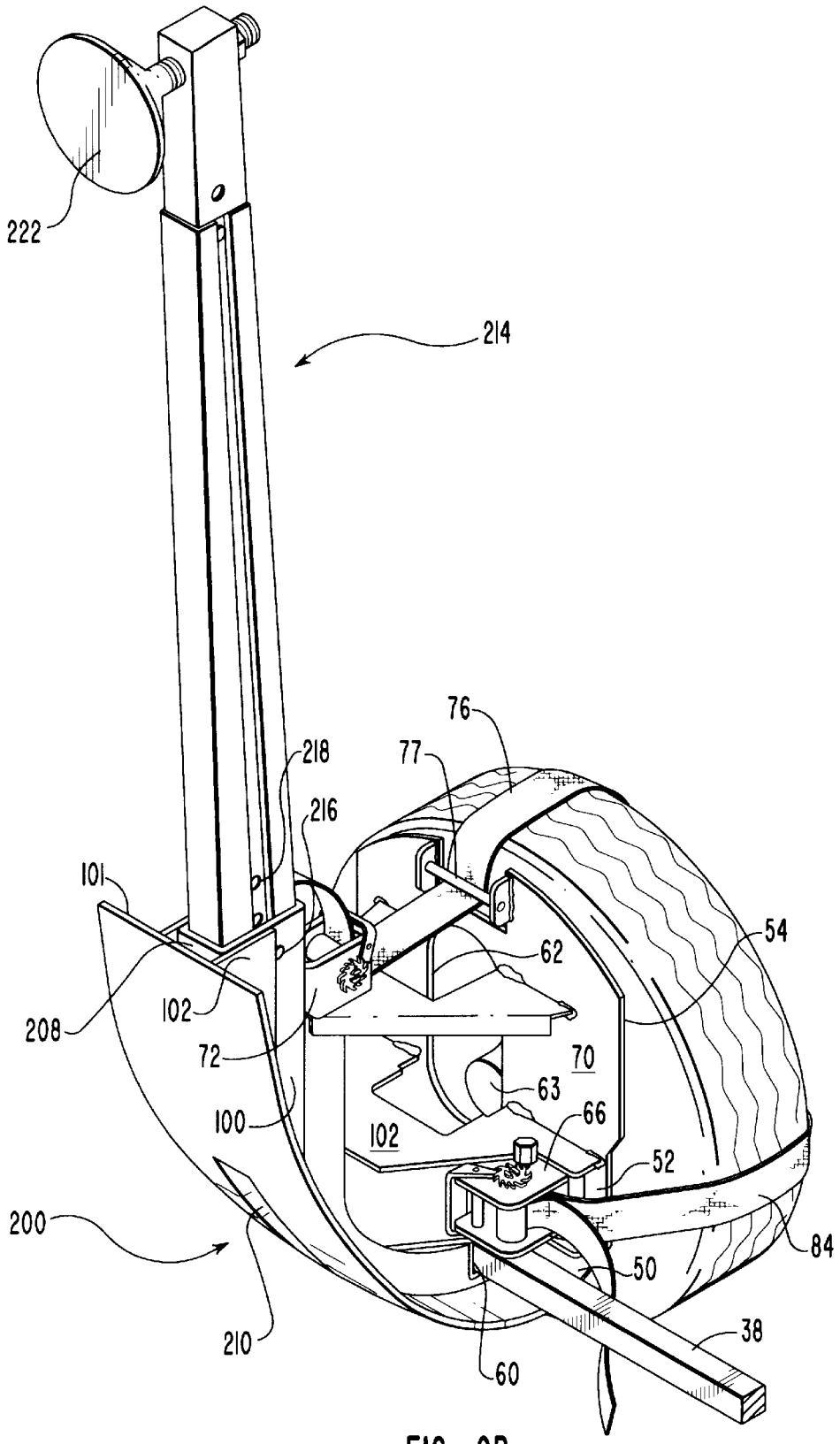

An extension arm 212, as shown in FIG. 9A or an extension arm 214, shown in FIG. 9B, has an end insertable into the receiver 208 and secured by a pin 216 inserted through in the receiver member and a selected hole 218 in the extension arm 212 and 214. The inserted end of the extension arm used may project fully through opening 210 to provide further stability to the apparatus, including the tilted vehicle, if desired.

Extension arm 212 has a wheel 220 journaled on a non-inserted end so that when wheel rockers 200 are in place on the wheels at one side of the vehicle and the extension arms 212 are inserted and the vehicle is fully tilted, then the other extension arms are inserted and the vehicle can be moved using the wheels 220.

If extension arms 214 are used in place of the arms 212, pads 222, adjustably screwed into the non-insertable ends of the arms 214, will provide better stability for the tilted vehicle even in soft ground or on carpet, or the like. The extension arms 212 and 214, or similar such arms can be inserted into and be locked together with the ends of socket receiver 208. This also provides added stability to the system should that be deemed necessary and may facilitate movement of the tilted vehicle, should that be desired.

In FIG. 9, a support bar 226 welded or otherwise affixed to and extending across the socket receiver member 208 has reinforcement tubing members 228 and 230 affixed to opposite sides thereof. Telescoping receiver members 234 and 236 are respectively pivotally connected to the reinforcement tubing members 228 and 230. The telescoping receiver members 228 and 230 receive ends of insert members 234 and 236, the other ends of which have plates 244 and 246 thereon. A crossbar 248 interconnects the insert members 240 and 242 adjacent the plates 244 and 246. A roller 250 is centered on and revolves around the crossbar 248.

Insert members 234 and 236 telescope into and out of the telescoping receiver members 228 and 230 and are locked in position such that the plates 244 and 246 will engage the tire sidewall, wheel, or hub of the vehicle being tilted. A bolt 252 is inserted through holes in each of the telescoping receiver members 228 and 230 and through a selected hole 256 in each of the insert members 240 and 242 before being threaded into a selected hole 255 of an arcuate brace 258. The spaced apart arcuate braces 258 are welded or otherwise affixed to the tubing member 204.

A semi-circular plate 260, having notches 262 spaced around its outer periphery, is welded or otherwise affixed to the tubing member 204. A pair of arms 266 and 268 each have one end pivotally and loosely mounted to a pivot pin 270 at the radial center of the plate 250. Each of the arms 266 and 268 have a pin 272 projecting therefrom to fit into a selected notch 262. The loose connection of the arms 266 and 268 on the pivot pin 270 allows the arms 266 and pins 272 to swing away from plate 260 and the pins 272 to be free of the notches 262 as the arms 266 and 268 are pivoted about the pin 270 and the pins are each reset in a notch 262 as required for a particular vehicle wheel size.

As best shown in FIG. 10, a tire guide 274 extends from each arm 266 and 268 and has an arm 276 that extends across the tread portion of a tire of the vehicle.

A loop 280 on each arm 266 and 268 serves as an anchor for one end of a strap 282. Strap 282 passes to the rear of a tire of the vehicle and through an arcuate, flat sleeve 284 of a top center plate 286 to have its ends 288 and 289 anchored to the arms 266 and 268, respectively.

Another strap 290 is fixed to a central neck 292 of the top center plate 286, extends over the tire, beneath the roller 258 and is secured to and rolled on a reel of a manually or motor operated ratchet assembly 294.

In practice, a wheel rocker 200, FIG. 9 or 10 is attached to each of the wheels at one side of a vehicle to be tilted. This is done by positioning and adjusting each wheel rocker 200 such that tire guides 274 engage the periphery of the tire regardless of the size of the tire. The plates 244 and 246 will engage the outside sidewall of the tire; and top center plate 286 is positioned at the rear top of the tire to have sleeve 284 behind the tire and neck 292 extending at least partially across the tread of the tire. Operating of ratchet assembly 292 to take up the strap 290 then snugly secures the apparatus to the wheels.

With the wheel rockers in place a rocker support bar may be positioned between them and the apparatus can be operated through a central rocker, as previously described.

As shown best in FIGS. 11, 11A, 11B, 11C, 11D, and 11E, a wheel rocker shown generally at 300 is constructed like the wheel rocker 200, which rocker is adapted to be strapped to a tire, wheel or hub, as is the wheel rocker 32. In this embodiment, however, a receiver 302 is formed to be generally U-shaped, with sidewalls 304 and 306 and a top wall 308. Unlike the receiver 208, receiver 302 is open at the bottom 303.

Oppositely extending, extension arms 310 and 312 each have an end 314 adapted to be inserted into receiver 302 and to be secured by a first pin 316 passed through the holes 318 in walls of the receiver and hole 319 of the extension arms 310 and 312. A second pin 321 is inserted through another selected hole 322 through the walls of the receiver and a hole 320 through the extension arm. The holes 322 are positioned such that when an extension arm 310 and 312 is locked into a selected hole 322 the extension arm extends at a selected angle out of the open bottom 303 of the wheel cradle 300. Each of the extension arms 310 and 312 are flared from the end 314 to a remote end 324, and includes a flat bottom surface 326. A receiving socket 328 is formed in the remote end 324, of each extension arm 310 and 312.

A roller plate set 330 having opposite ends with rollers 332 and 334 journaled thereon, is adapted to be connected by bolts 340 to flat bottom surface 326 of each of the ends 314 of the extension arms of 310 and 312.

Additional wheels or other support structure may be coupled to the receiving sockets 328, if desired.

Figure 11:
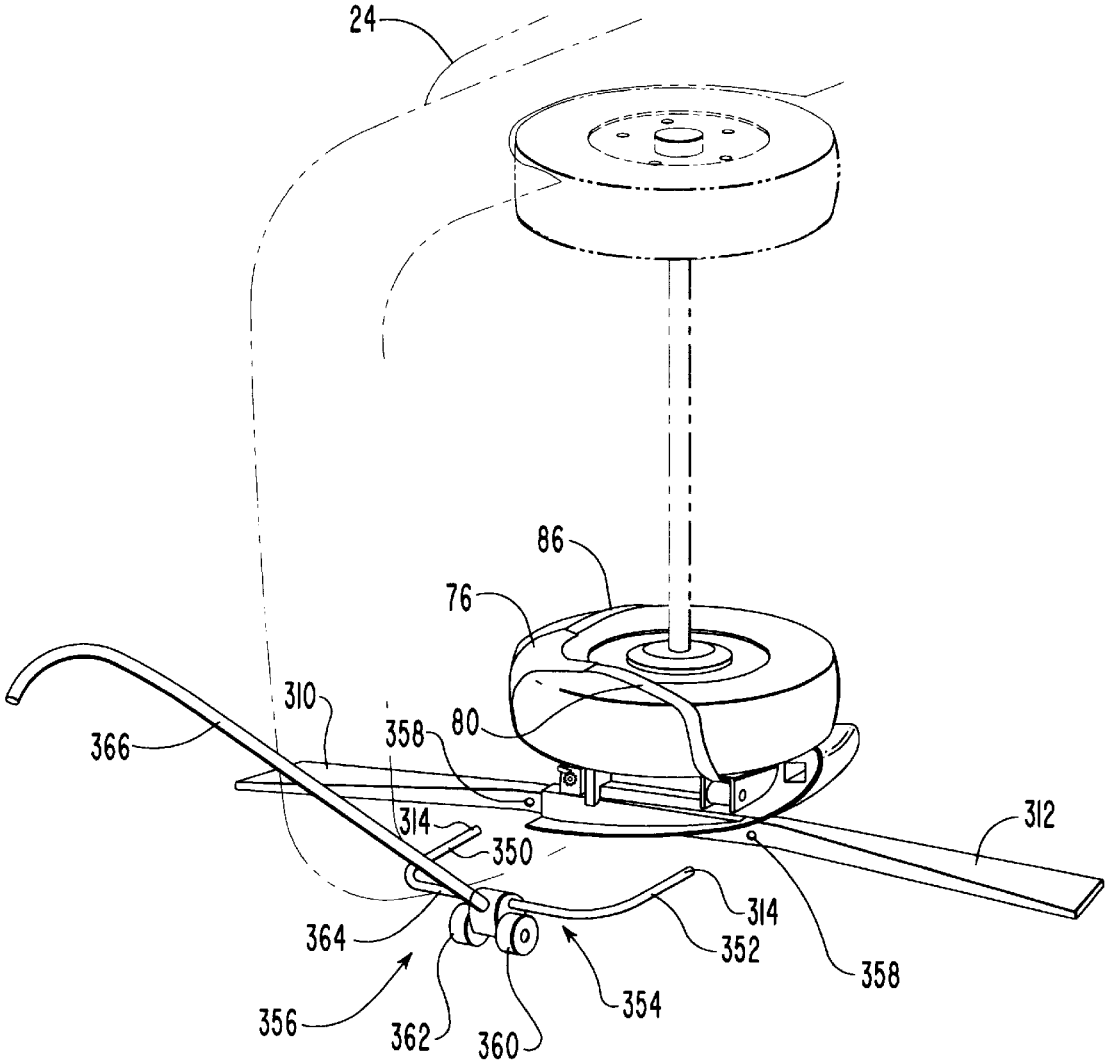
Figure 11A:
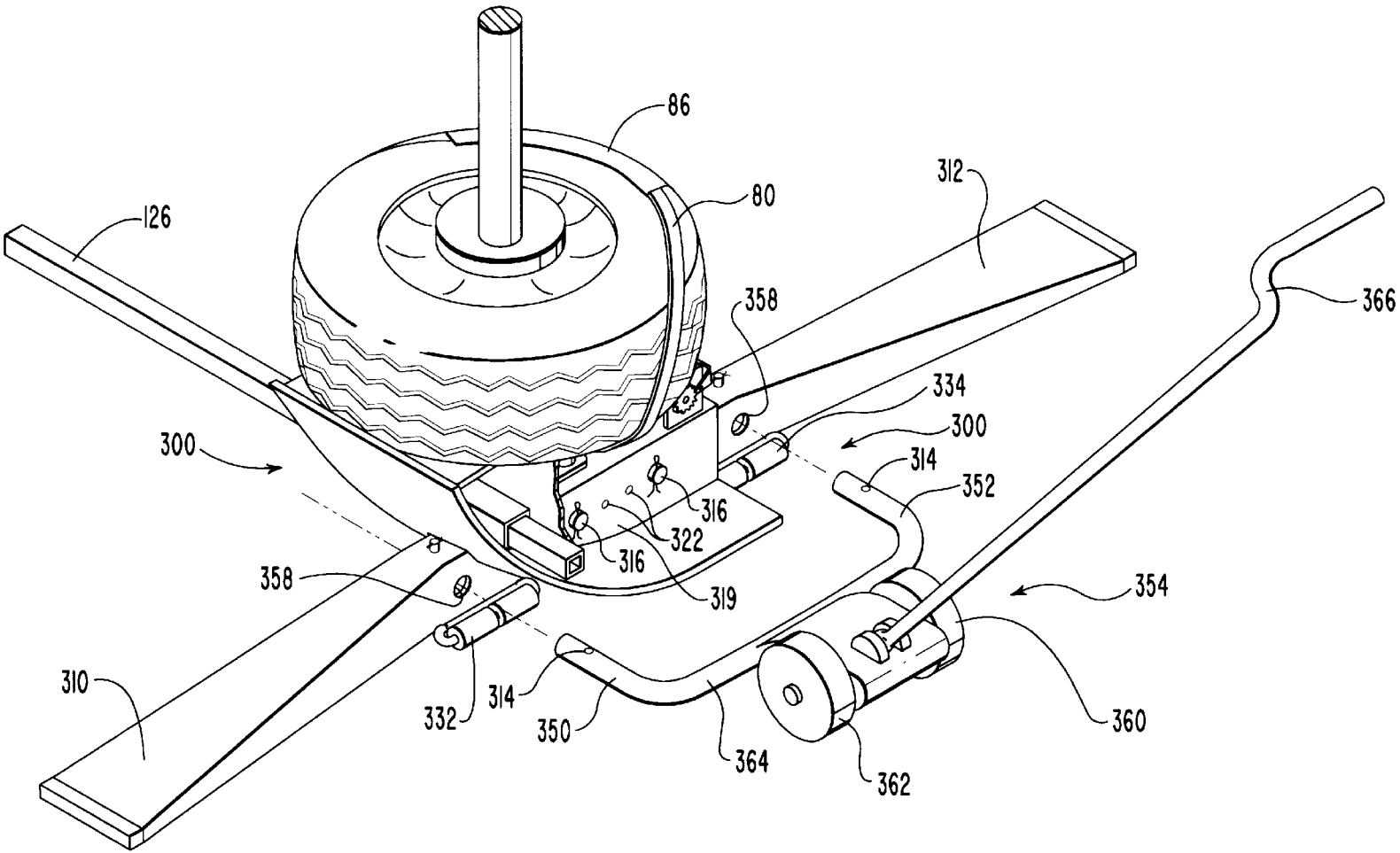
Figure 12:
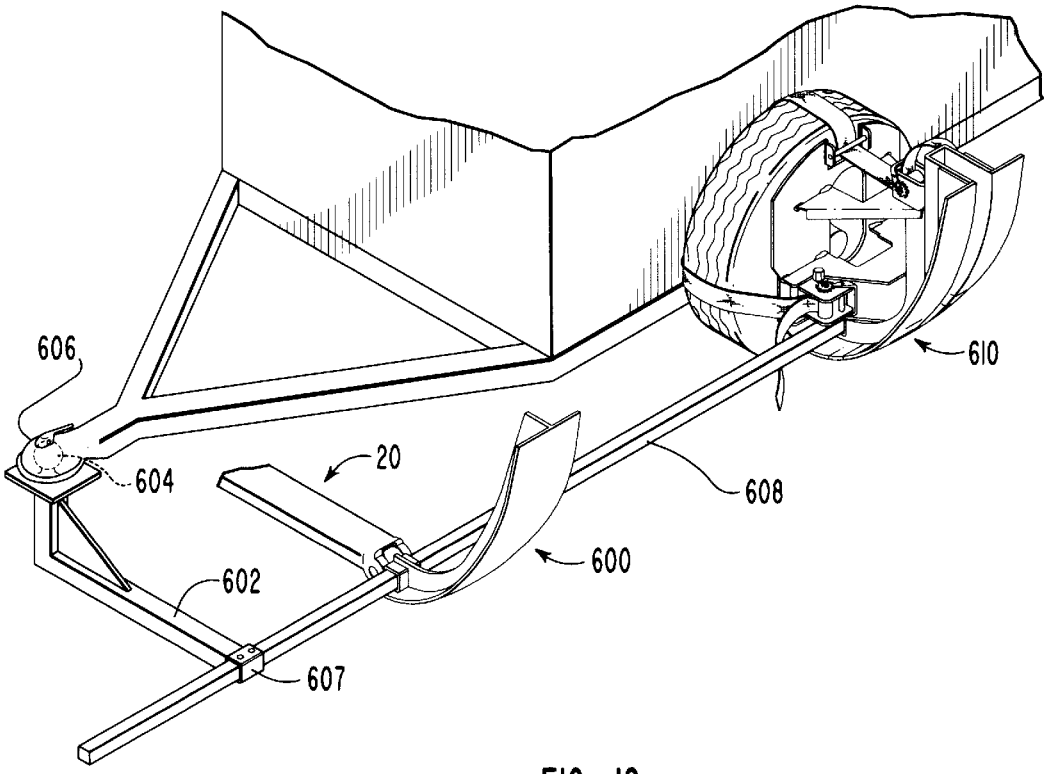

Spaced forks 350 and 352 of a U-shaped member 354 tow truck, shown generally at 356 in FIGS. 11 and 12 extend through additional holes 358 in the extension arms 310 and 312. Wheels 360 and 362 are journaled to the web 364 of the U-shaped member 354 and a handle 366 extends from the web 364 such that when the forks 350 and 352 are inserted through holes 358 and the handle 366 is pushed down, the forks rotate about the wheels 360 and 362 to raise the wheel cradle and to take load off the extension arms 310 and 312 as a tilted vehicle is moved by pushing or pulling of the tow truck 354.

While not shown, it will be apparent that extension arms like those shown at 310 and 312 can also be inserted into the base shaft 128 in the same manner as the base shaft extension member previously described.

As shown in FIG. 12, a trailer vehicle can be tilted through a tongue tipping rocker 600 that functions in the same manner as the central tipping rocker 20, previously described. A connector arm 602 has a ball 604 at one end to be coupled to socket 606 of the trailer tongue. The other end of the arm 602 has a sleeve 607 through which the rocker support bar 608, that also extends through wheel rocker 610 secured to the outermost wheels at one side of the trailer and the tongue rocker 600, is non-rotatably inserted. The tongue tipping rocker may be used to tip the vehicle. When so used, the rocker bar 608 extends through the tongue tipping rocker and through wheel rockers strapped to wheels on one side of the trailer and the tongue tipping rocker is releasably connected to a base shaft operated to rotate the tongue rocker in the manner previously described.

Although preferred embodiments of the invention have been herein described, it is to be understood that the present disclosure is made by way of example and that variations are possible without departing from the subject matter coming within the scope of the following claims, which subject matter is regarded as the invention.

I claim:

1. A vehicle side tilting apparatus comprising a wheel rocker having an arcuate ground engaging surface such that rolling contact of the arcuate surface with the ground allows the vehicle to be tilted on its side, a strap tightener fixed within the curve of said arcuate ground engaging surface and straps having a length to extend transversely across an arcuate portion of a vehicle wheel and to be attached to said strap tightener, whereby actuation of said strap tightener will tightly secure said wheel rocker to a vehicle wheel to which said wheel rocker is attached.

2. A vehicle side tilting apparatus as in claim 1, wherein the wheel rocker further includes receivers for removable extension arms fixed to said arcuate ground engaging surface and mounted to receive extension arms projecting both transverse to and in the plane of the arcuate ground engaging surface.

3. A vehicle side tilting apparatus as in claim 2, wherein the wheel rocker further includes at least one extension arm removably secured in at least one receiver and projecting from the arcuate ground engaging surface.

4. A vehicle side tilting apparatus as in claim 3, wherein the wheel rocker further includes roller means fixed to the extension arm.

5. A vehicle side tilting apparatus as in claim 4, wherein the roller means fixed to the extension arm comprises wheels removably secured to the end of said extension arm adjacent to the arcuate ground engaging surface.

6. A vehicle side tilting apparatus as in claim 4, wherein the roller means fixed to the extension arm comprises a plate removably fixed to a bottom of said extension arm and spaced apart rollers journaled on said plate.

7. A vehicle side tilting apparatus comprising a wheel rocker having an arcuate ground engaging surface such that rolling contact of the arcuate surface with the ground allows the vehicle to be tilted on its side; and strap means secured to said wheel rocker interiorly of said ground engaging surface; and means to tighten said strap means to secure said wheel rocker to a vehicle wheel, with the arcuate ground engaging surface projecting from one side of said vehicle wheel.

8. A vehicle side tilting apparatus as in claim 7 wherein the means to tighten the strap means includes at least one strap tightener and the strap means includes at least one strap to extend behind said wheel to be engaged by said strap tightener to secure the wheel rocker to a vehicle wheel.

9. A vehicle side tilting apparatus as in claim 8 wherein the strap means further comprises a pair of tire guides and means to position each of the tire guides to be fixed adjacent to a periphery of a tire of a wheel, said strap being attached to each of said tire guides.

10. A vehicle side tilting apparatus as in claim 9 wherein the strap attached to said tire guides passes through a sleeve positioned between said tire guides and wherein said strap means includes a second strap having one end fixed to said sleeve and the other end attached to said strap tightener.

11. A vehicle side tilting apparatus as in claim 10, wherein each tire guide has a pin projecting therefrom to be selectively positioned in a selected notch formed in the arcuate periphery of a plate fixed to the arcuate ground engaging surface.

12. A vehicle side tilting apparatus as in claim 11 further including a pair of adjustable length extension arms pivotally connected to the arcuate ground engaging surface to have ends thereof engage a front of a wheel to which the wheel rocker is attached.

13. A vehicle side tilting apparatus as in claim 12, further including means to secure said extension arms in a selected pivoted angular position.

14. A vehicle side tilting apparatus as in claim 13, further including means to roll the wheel rocker on the arcuate ground engaging surface.

15. A vehicle side tilting apparatus as in claim 14 wherein the means to roll the wheel rocker includes a rocker bar extending transverse to the plane of the arcuate ground engaging surface and fixed to the wheel rocker.

16. A vehicle side tilting apparatus as in claim 15, further including a tubing member fixed to the wheel rocker and telescopingly receiving the rocker bar and means for interlocking the tubing member and the rocker bar to rotate together about a common axis.

17. A vehicle side tilting apparatus as in claim 16, further including a socket receiver on the wheel rocker and extending transverse to the tubing member and oppositely extending extension arms each having one end inserted into the socket receiver and other ends extending from opposite ends of the arcuate ground engaging surface and means for releasably securing said ends of said extension arms in said socket receiver.

18. A vehicle side tilting apparatus as in claim 17, wherein each extension arm has a flat bottom surface and roller means releasably connected thereto.

19. A vehicle side tilting apparatus as in claim 18 further including means providing selected angular connections between the wheel rocker and the extension arms.

20. A vehicle side tilting apparatus as in claim 19 wherein the means to roll the wheel rocker includes a tipping rocker fixed to the rocker bar, whereby rolling of the tipping rocker is transmitted through the rocking bar to the wheel rocker to roll said wheel rocker.

21. A vehicle side tilting apparatus as in claim 20 further including a tow truck having a handle, wheels and projecting fingers extending angularly from the handle and holes in the wheel rocker to receive said fingers.

* * * * *